United States Patent [19]

Brown et al.

[11] 4,267,617

[45] May 19, 1981

[54] CARPET SCRUBBER WITH IMPROVED BRUSH

[75] Inventors: Robert S. Brown, Spartanburg; Larry S. Satterfield, Moore, both of S.C.

[73] Assignee: Milliken Research Corporation, Spartanburg, S.C.

[21] Appl. No.: 57,864

[22] Filed: Jul. 16, 1979

[51] Int. Cl.[3] ..... A47L 5/30

[52] U.S. Cl. ..... 15/320; 15/384

[58] Field of Search ..... 15/320, 383, 49 C, 50 C, 15/50 R, 384, 79 R, 79 A

[56] References Cited

U.S. PATENT DOCUMENTS

| | | | |
|---|---|---|---|
| 1,596,041 | 8/1926 | Young | 15/320 |
| 1,644,859 | 10/1927 | Strader | 15/384 X |
| 2,293,722 | 8/1942 | Erickson | 15/320 |
| 3,740,783 | 6/1973 | Kopecky | 15/384 X |
| 3,875,605 | 4/1975 | Fegan | 15/384 X |
| 4,137,590 | 2/1979 | Brown | 15/50 R |

*Primary Examiner*—Christopher K. Moore

*Attorney, Agent, or Firm*—Earle R. Marden; H. William Petry

[57] ABSTRACT

A new and improved brush for a carpet scrubber with a flat, even continuous outer bristle extremity.

1 Claim, 11 Drawing Figures

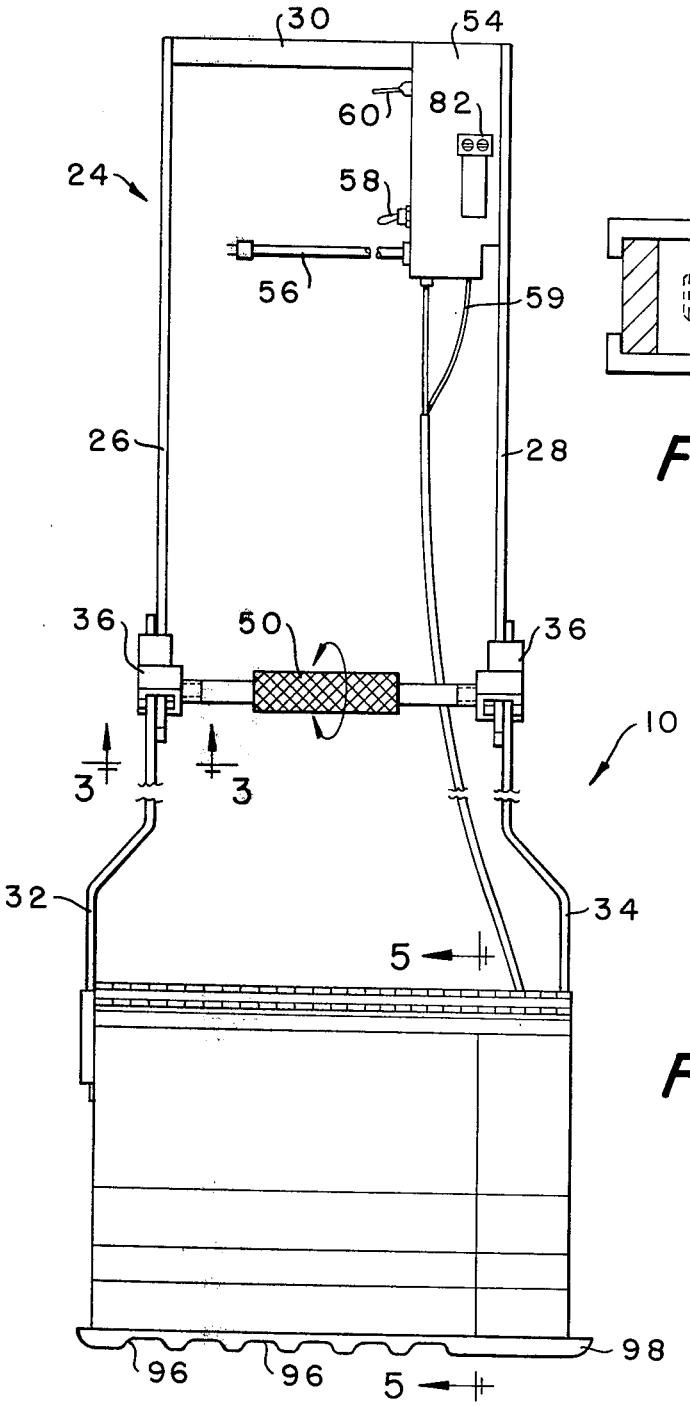
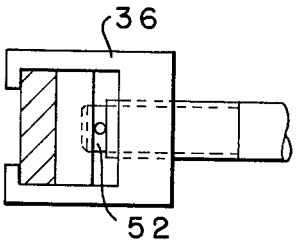
FIG.-3-
FIG.-1-

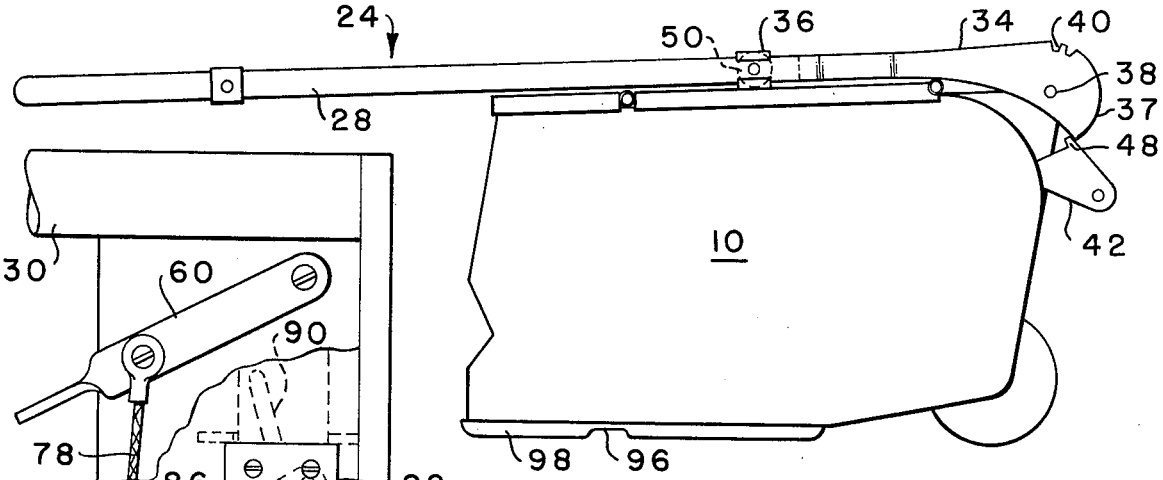
FIG.-4-
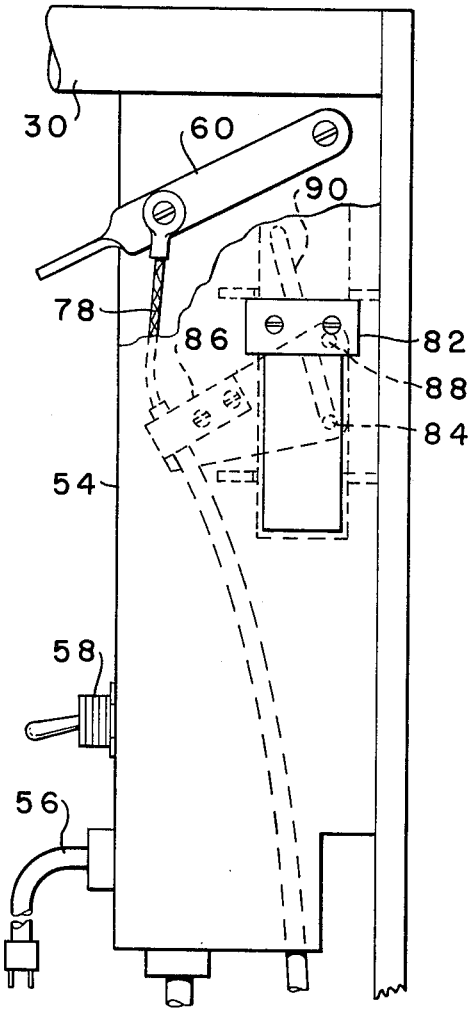
FIG.-8-
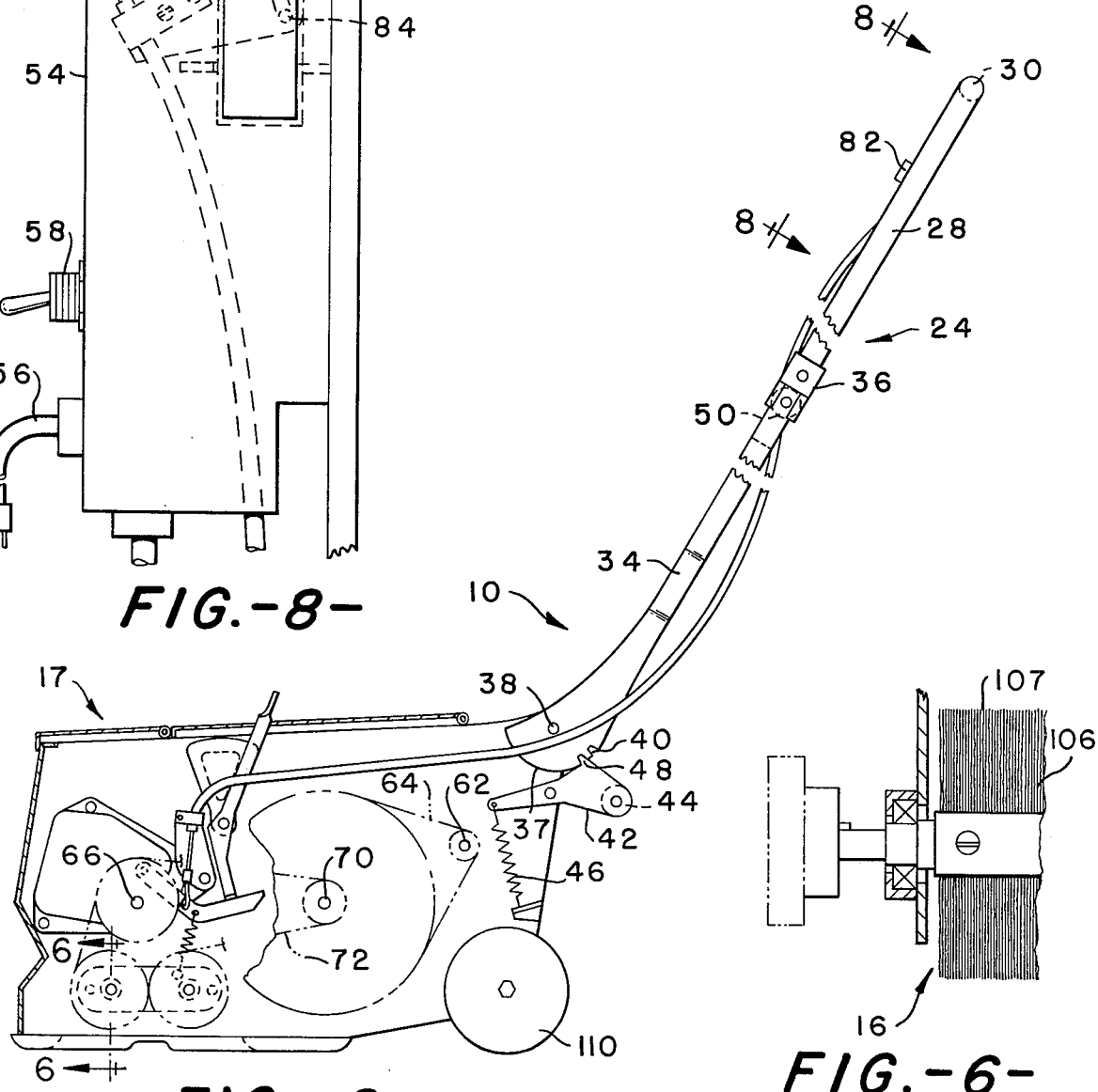
FIG.-2-
FIG.-6-

CARPET SCRUBBER WITH IMPROVED BRUSH

Many consider wall-to-wall carpeting to be the peak of luxury; housewives love it for the warm atmosphere it brings; businessmen value it for the air of corporate dignity it lends their offices; but to those who must clean and maintain it, wall-to-wall carpeting is an immense headache. It must be cleaned in place; the cleaning must be accomplished in a relatively short time and if the carpet is not kept scrupulously clean, its life may be severely shortened. For these reasons, the carpet cleaning industry is constantly seeking improved methods and machinery for cleaning carpets.

Recently, a radically new approach to cleaning carpets has been developed which uses a powdered cleaning composition containing a mixture of extremely porous solid particles and a solvent. This new cleaning composition is described in U.S. Pat. No. 4,013,594 and has proved especially effective in removing soil from carpets. Further, only a short interval is required between application and removal of the powdered cleaning composition. Using this new cleaning composition, it has now become possible to clean wall-to-wall carpets in offices and stores during working hours with little disruption of normal affairs. However, this progress in cleaning compositions has exposed shortcomings in the carpet cleaning machines known to the prior art.

When the devices which are known to the prior art are used with this new powdered cleaning composition, it is found that some areas of the carpet are cleaned much better than other areas and that a streaked appearance results. It is theorized that this streaked appearance is due to the fact that the powder, unlike a liquid, must be physically moved into intimate contact with the fibers to be cleaned; therefore, to obtain the full benefit of the powdered cleaning composition, it is thought to be desirable to provide a device which is capable of transmitting a great deal of energy to the carpet in order to bring the powdered cleaning composition into intimate contact with the fiber while distributing this energy uniformly over the area which is scrubbed.

It is therefore an object of the invention to provide a novel brush which provides improved cleaning of carpets.

Other objects and advantages of the invention will become readily apparent as the specification proceeds to describe the invention with reference to the drawings, in which:

FIG. 1 is a front elevation view of the new and improved carpet cleaning machine;

FIG. 2 is a side elevation view of the improved carpet cleaning machine with portions removed to show details thereof;

FIG. 3 is a view taken on line 3—3 of FIG. 1;

FIG. 4 is a side elevation view similar to FIG. 2;

FIG. 6 is a partial view taken on line 6—6 of FIG. 2;

FIG. 8 is an enlarged view of the carpet machine control box of FIG. 1 with portions removed to show the interior thereof;

Figure 5:
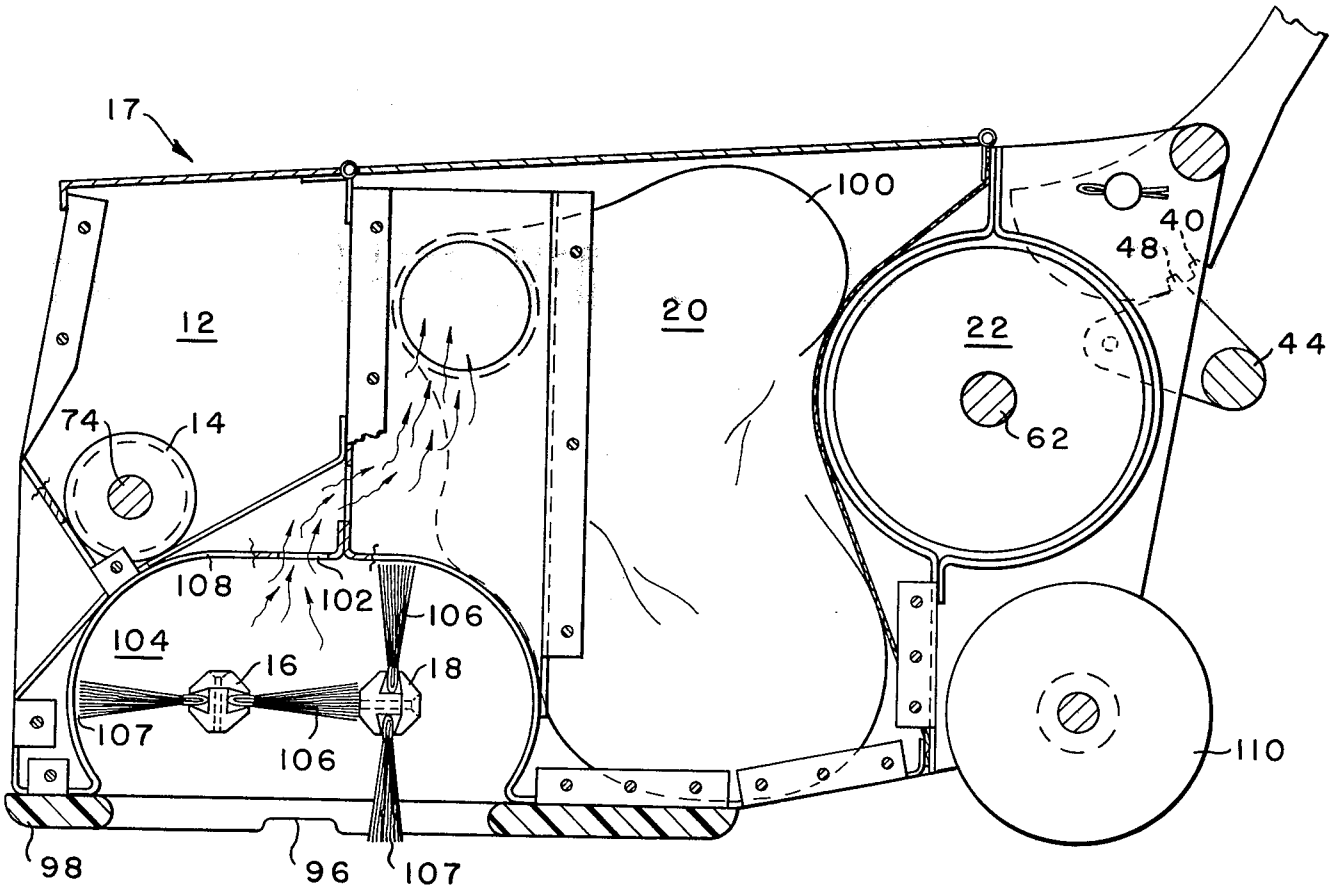
FIG. 5 is a cross-section view taken on line 5—5 of FIG. 1.

Looking now to the drawings, a carpet cleaning machine 10 of the type generally disclosed in U.S. Pat. No. 4,137,590 is shown. As disclosed in U.S. Pat. No. 4,137,590, the machine 10 dispenses a damp cleaning compound from a powder chamber 12 by the use of a driven reticulated foam cylinder 14 in front of the direction of travel of the machine 10 so that the brushes 16 and 18 will thereafter encounter the powdered area to be cleaned. The machine will then scrub the area and thereafter can be automatically connected to a vacuum machine to take up the powder and accumulated and/or absorbed dirt.

The carpet cleaning machine consists basically of a body portion 17 which houses the powder chamber 12; brushes 16 and 18; vacuum chamber 20, the motor 22 for the brushes 16 and 18, the foam cylinder 14 and the fan (not shown) to create the vacuum in the chamber 20 and the handle arrangement 24 to move the carpet cleaning machine.

The handle arrangement 24 consists of an upper portion having a pair of arms 26 and 28, connected together by a handle 30, which cooperates slidably with the pivotably mounted lower arms 32 and 34 through a pair of connectors 36. The bottom portion 37 of each of the arms 32 and 34 is enlarged to allow pivotal movement at 38 and to accommodate grooves 40 which are engaged by spring loaded detent lever 42. To adjust the position of the handle arrangement 24 or to place it in the position for storage, as shown in FIG. 4, the bar member 44 can be moved to pivot the detent lever 42 against the bias of springs 46 to either move the detent 48 into another notch 40 or to fold the handle arrangement 24 over as in FIG. 4 for storage. To further facilitate the storage of the carpet cleaning machine 10, the upper arms 26 and 28 can be slid downward through the connector 36 by rotating the knurled arm 50 to screw the nipple 52 out of a slot in the upper arms to allow the upper arms to be slid towards the lower arms to form a compact package which can be readily stored.

Figure 7:
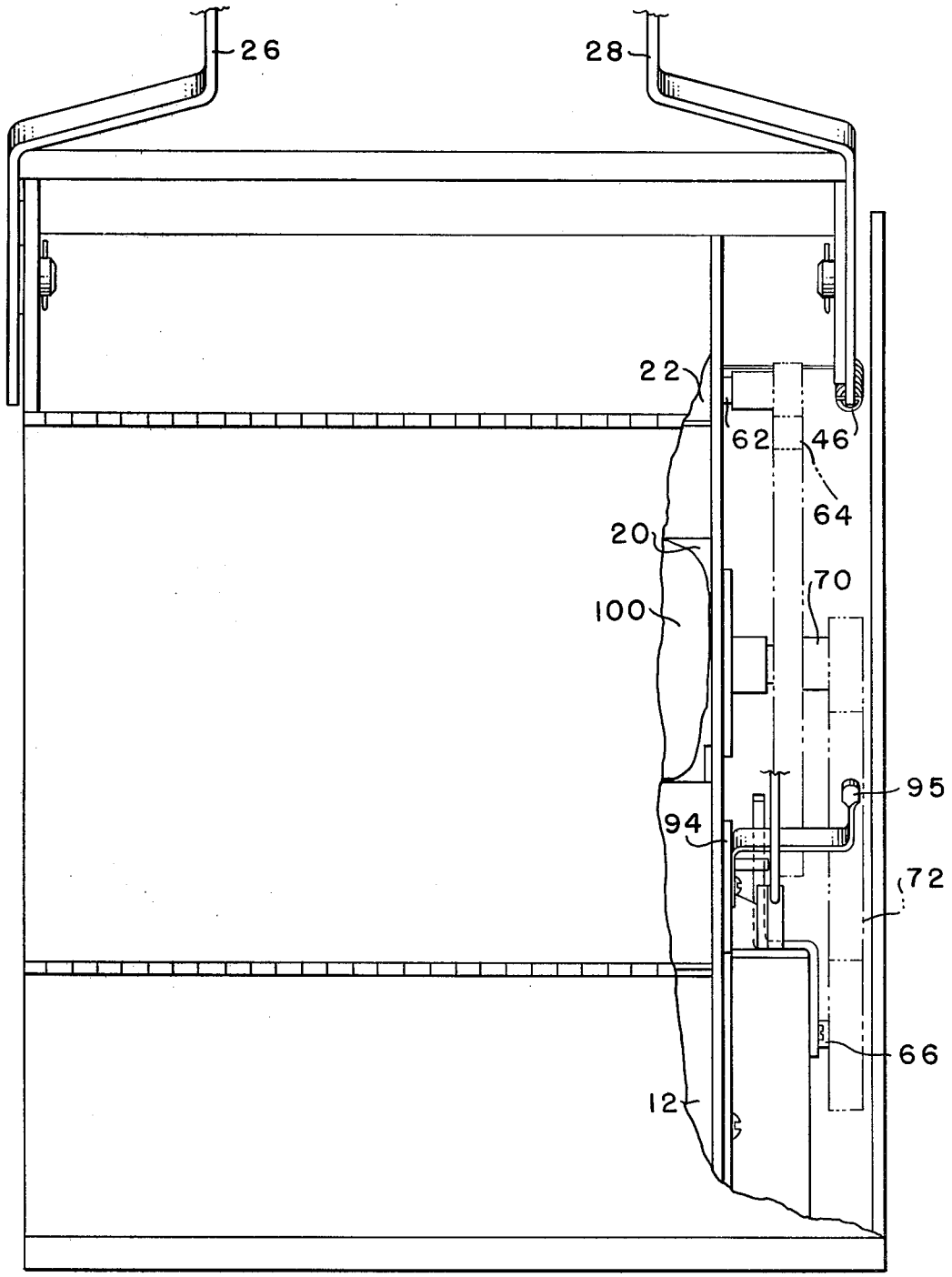
FIG. 7 is a top view of the improved carpet cleaning machine with a portion of the casing removed to show the drive system.

Mounted to the upper arm 28 is the control box 54 which receives power from the cable 56. Mounted on the box 54 is the on-off switch 58 which controls the power to the motor 22. The lever 60 controls the operation of the foam cylinder 14. The on-off switch 58 through the power cable 59 controls the power to motor 22 which drives the vacuum fan (not shown) integrally connected to the motor, the brushes 16 and 18 and the foam cylinder 14. Looking at FIG. 7, it can be seen that the motor 22, through the shaft 62 and drive belt 64 indirectly drives the shaft 66 for the foam cylinder drive linkage 68 and the brush shaft located underneath thereof through the jack shaft 70 and drive belt 72. Thusly, the on-off switch 58 controls all the power to the driven parts of the carpet cleaning machine 10.

Figure 9:
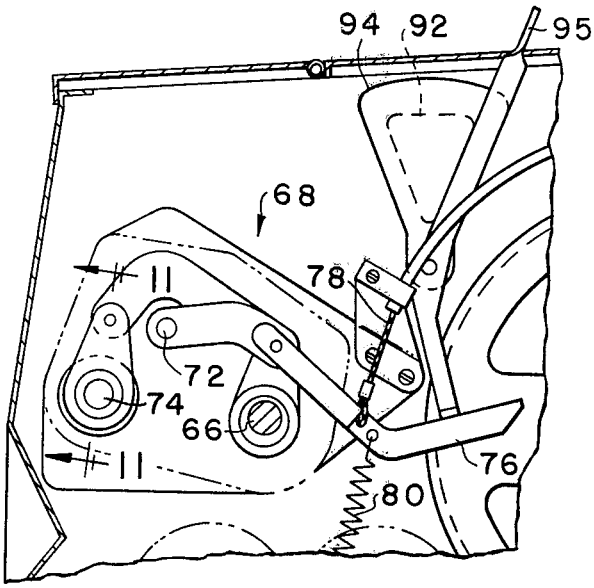
FIGS. 9 and 10 show the carpet cleaning powder roll dispensing drive mechanism in the off and dispensing positions, respectively.
Figure 11:
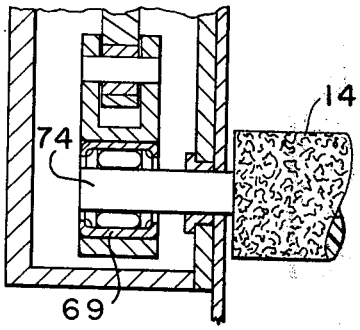
FIG. 11 is a view taken on line 11—11 of FIG. 9.
Figure 10:
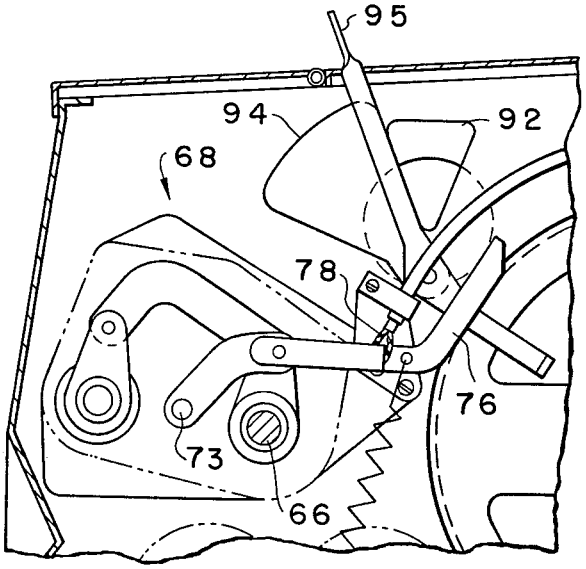

As briefly discussed above, the lever 60 controls the operation of the foam cylinder drive linkage 68 which in turn provides the drive for the foam cylinder 14 from the shaft 66. The linkage 68 is a conventional Watts II type linkage, sold by The Zero-Max ® Industries, Inc., Minneapolis, Minnesota, which through a clutch 69 incrementally rotates the foam cylinder 14 to deposit cleaning powder on the area to be cleaned. As shown in FIGS. 9 and 10, the position of the pivot point 73 determines the amount of movement of the foam cylinder shaft 74. FIG. 9 represents minimum or zero movement of the shaft 74 while FIG. 10 represents maximum movement of the shaft. The position of the pivot point 73 is controlled by the lever 76 whose position, in turn, is controlled by the cable 78 connected to the control 60. The position of the trigger or lever 60 in FIG. 8 corresponds to the minimum or zero powder position of FIG. 9 when the cable 78 is fully extended allowing the spring 80 to pivot the lever 76 to the position indicated. When the lever or trigger 60 in FIG. 8 is pulled all the way up to pull the cable upwards the lever 76 will assume the position shown in FIG. 10 thereby providing maximum rotation of the foam cylinder 14. Intermediate powder dispensing positions may be set for the lever 60 by moving the adjustment member 82 upwards or downwards to move the fixed pin 84 to pivot the support 86 about the pivot point 88 as the elongated groove 90 is moved by the adjustment member 82. Pivotal movement of the support member 86 will shorten or lengthen the cable 78 attached thereto thereby effecting the effect of the lever 60 on the position of lever 76 which in turn effects the transmission of power from the shaft 66 to the foam cylinder shaft through the Watts II linkage.

Since the vacuum fan is not driven by a separate motor, it should be noted that when powder is being deposited on the surface to be cleaned, the vent 92 to the atmosphere should be open, as in FIG. 10, so that the fan will not cause the powder to be sucked up before the brushes can accomplish the cleaning functions. When it is desired to vacuum the cleaned surface, the lever or trigger 60 will be moved to the down position to deactivate the powder foam cylinder dispenser and the vent 92 will be closed by the pivotally mounted shutter 94 (FIG. 9) to cause the vacuum fan to pull air through the grooves 96 in the floor plate 98 to suck the dispensed powder and accumulated soil up into the collection bag 100 in the vacuum chamber 20.

FIG. 5 shows the interior of the carpet cleaning machine in cross-section and, as indicated by the arrows, the air flow, when the vent 92 is closed, passes upwardly through the opening 102 in the brush chamber housing 104. The brushes 16 and 18 are driven in opposite directions to each other 90° out of phase to prevent entanglement with each other but at the same time allow concentrated action on the carpet being cleaned. It should be noted that the brushes have a continuous line of bristles 106 with the outer extremities 107 of the bristles being substantially even. Further, the length of the bristles 106 are so selected that they extend closely adjacent the interior wall 108 of the housing 104 so that any accumulated cleaning powder on the housing will be cleaned off by the tips of the rotating brushes 16 and 18. It should be noted in FIGS. 5 and 6 that the bristles 106 are mounted in the brushes 16 and 18 to provide groups of rows of elongated bristles with the bristles in each row forming a substantially continuous line and being substantially the same length. Each group of rows has an outer circumference substantially less than an arc with a sub-tended angle of 20°.

OPERATION

When it is desired to clean a certain area of carpet, the powder chamber 12 of the machine 10 is loaded with cleaning powder. The powder cable 56 is plugged into an appropriate electrical outlet and the trigger 60 and adjustment member 82 adjusted to supply the desired amount of cleaning powder. The machine 10 is turned on by actuation of the switch 58 and is then slowly pushed across the area to be cleaned on the wheels 110 with the floor plate 98 in contact with the surface to be cleaned. The brushes 16 and 18 will act upon the powdered surface of the carpet to enhance the cleaning action of the powder on the carpet surface. When the cleaning action has been completed, the trigger 60 will be placed in its lower-most position to cut off the operation of the foam cylinder 14 and the vent 92 is closed to position shown in FIG. 9 by grasping the handle 95 and pivoting the shutter 94 over the vent. The machine 10 is then again moved over the powdered and cleaned areas of the surface and the powder and accumulated soil is sucked up into the vacuum bag 100 through the brush housing 104. The machine can then be disconnected by pulling out the power cable 56 and the arms collapsed and telescoped for storage as hereinbefore described.

It is obvious that the herein described apparatus will efficiently clean a dirty surface with a minimum effort and can be readily compacted for storage while not in use.

Although the specific embodiment of the invention has been described, it is contemplated that changes may be made without departing from the scope or spirit of the invention and it is desired that the invention be limited only by the claims.

We claim:

1. A carpet cleaning apparatus comprising: a frame, a housing mounted on said frame, means forming a powder dispensing chamber, a brush chamber and a vacuum chamber in said housing, a powder dispensing roll in said dispensing chamber, a collection bag in said vacuum chamber, brush means in said brush chamber, a single drive means driving said powder dispensing roll and said brush means, and handle means to move said carpet cleaning apparatus over an area to be cleaned, said brush means including at least two brushes, each of said brushes having a plurality of groups of rows of elongated bristles with the bristles in each row forming a substantially straight line and being substantially the same length, each of said groups of rows of bristles having an outer circumference substantially less than an arc with a subtended angle of 20° and with the groups of one brush being out-of-phase with the groups of the other brush, each of said brush means having an axis of rotation substantially parallel to each other which are spaced from one another a distance slightly greater than the radial length of said rows of bristles, said drive means rotating said brushes in a cylindrical path to allow the interdigitation of said brushes to allow intensified cleaning action on the carpet to be cleaned.

* * * * *